United States Patent [19]

Horimoto

[11] 4,272,285

[45] Jun. 9, 1981

[54] PROCESS FOR PRODUCING MAGNETIC METAL POWDERS

[75] Inventor: Rioichi Horimoto, Komoro, Japan

[73] Assignee: TDK Electronics Co., Ltd., Tokyo, Japan

[21] Appl. No.: 168,889

[22] Filed: Jul. 11, 1980

[30] Foreign Application Priority Data

Jul. 12, 1979 [JP] Japan ..... 54-87481
Jul. 12, 1979 [JP] Japan ..... 54-87482

[51] Int. Cl.[3] ..... C22B 5/12

[52] U.S. Cl. ..... 75/0.5 BA; 75/0.5 AA; 75/252; 148/105

[58] Field of Search ..... 75/0.5 BA, 0.5 AA, 252; 148/105

[56] References Cited

U.S. PATENT DOCUMENTS

| | | | |
|---|---|---|---|
| 1,747,854 | 2/1930 | Bozorth | 148/105 X |
| 1,878,589 | 9/1932 | Marris et al. | 148/105 |
| 2,351,462 | 6/1944 | Trageser | 148/105 |
| 3,545,959 | 12/1970 | Hougen et al. | 75/0.5 BA |
| 3,595,640 | 7/1971 | Stone et al. | 75/0.5 AA |
| 3,902,888 | 9/1975 | Aonuma et al. | 75/0.5 AA |
| 4,043,846 | 8/1977 | Amemiya et al. | 148/105 |
| 4,207,092 | 6/1980 | Berry | 75/0.5 AA |

*Primary Examiner*—G. Ozaki

*Attorney, Agent, or Firm*—Seidel, Gonda, Goldhammer & Panitch

[57] ABSTRACT

In a process for producing a magnetic metal powder, a magnetic metal compound is reduced by wet reduction in a state mixed with a clay or is heat treated in the presence of a clay powder. Alternatively, a magnetic metal powder is prepared by reducing a magnetic metal powder by wet reduction or by reducing a magnetic metal compound in a state mixed with a clay by dry reduction, and then the resulting powder is heat treated in the presence of the clay powder. The clay is typically kaolin.

5 Claims, No Drawings

PROCESS FOR PRODUCING MAGNETIC METAL POWDERS

BACKGROUND OF THE INVENTION

This invention relates to a process for producing magnetic metal powders.

Ferromagnetic powders hitherto used in making magnetic recording media have been the powders of maghemite ($\gamma$—$Fe_2O_3$), magnetite ($Fe_3O_4$), maghemite doped with cobalt, cobalt-doped magnetite, chromium dioxide, etc. However, as the quality requirements for magnetic recording media have recently become increasingly stringent, development of ferromagnetic powders having properties suited for higher density recording with greater sensitivity than heretofore is being called for. One of the material groups to which the developmental efforts are directed is the group of ferromagnetic metal powders, for example, of iron, cobalt, nickel, and alloys of at least two metals, including cobalt-iron and cobalt-nickel combinations.

Those ferromagnetic metal powders can be made by dry reduction, wet reduction, evaporation, thermal decomposition, and various other methods. Of those, typical methods in use on industrial scales are dry and wet reductions. Dry reduction is a general term for a variety of processes for converting ferromagnetic metal compounds by gas-phase reduction into elementary metals, including reduction with a reducing gas of the thermal decomposition product of an organic acid salt of a ferromagnetic metal, reduction with a reducing gas of an acicular oxyhydroxide which may or may not contain any of various metals or an acicular oxide obtained from such an oxyhydroxide, and reduction of an oxalate or formate of a ferromagnetic metal in a hydrogen stream. Wet reduction, on the other hand, is a technique of reducing a ferromagnetic metal salt by adding a reducing agent to a solution of the salt. In either case the powdery product obtained is customarily heat treated in order to adjust its magnetic properties, increasing its coercive force (Hc) in particular, so that the product may be suited for use in high density recording media. The heat treatment is especially important for the magnetic powder formed by wet reduction. The heat treated powder is continuously taken out of the oven into a tank, where it is impregnated with an antioxidant solvent, and then transferred to a step for producing a magnetic coating material for the manufacture of a magnetic recording medium. In that step the ferromagnetic metal powder is mixed with a binder and additives needed to prepare a magnetic coating material. The product is applied in the usual manner on a base to form a medium for magnetic recording such as a magnetic tape.

During the course of manufacture briefly outlined above, there are stages at which the magnetic metal particles being treated are heated while in contact with one another, with the possibility of the particles being aggregated or sintered together.

For example, in dry reduction, the reaction is effected by passing a reducing gas through a reactor, such as a rotary kiln, charged with a metal compound powder to be reduced. Although the reduction temperature varies with the kind of the metal compound to be reduced, the reaction at the highest temperature feasible is desired if improvements are to be attained in the magnetic properties, such as remanent magnetization and saturation magnetization, and further in productivity. On the other hand, the high treating temperature involves an increased possibility of sintering to a disadvantage. The aggregation of the particles with heat as mentioned above retards the reduction reaction. Consequently, the metal particles do not exhibit the desired magnetic properties, and the squareness ratio (SQ) of the particles as sintered is low, failing to reach the level of 0.5 or upwards required for magnetic recording media.

Similarly, the heat treatment poses the sintering problem. The heat treatment usually is conducted by a rotary kiln or an apparatus equipped with agitator blades inside and also with a heating jacket over the outer wall. The jacket heats the charge at temperatures adjustable up to 500° C. The atmosphere for heat treatment is a nonoxidizing, preferably a reducing, gas atmosphere. The heat treatment time, which ranges from about one to about 30 minutes, naturally depends on the temperature. Considering the effect and efficiency of heat treatment the use of a high temperature, i.e., in the proximity of 400° C., is advisable. However, the treatment at such a high temperature is accompanied with a disadvantage of an increased possibility of the magnetic metal particles being sintered. The product of dry reduction takes the form of needle-shaped particles with a major-to-minor axis ratio in the range of 5-20, whereas the particles obtained by wet reduction tend to be connected or linked like necklaces. The relatively slender particles, when exposed to a high temperature with stirring in a heat treating apparatus, easily undergo sintering, or aggregation of the particles at contacting portions.

SUMMARY OF THE INVENTION

After an extensive search for a way of preventing the sintering of the particles during the course of dry reduction and subsequent heat treatment for the manufacture of the magnetic metal powder, I have now found it very useful, in attaining the end, to mix a clay, typified by kaolin or bentonite, with the particles to be treated. Fine clay particles, mixed in the powdery material, will scatter between the grains or particles of the latter to keep them out of direct contact. Aside from this physical aspect, powdered clay has also a chemical aspect in its actions preventive of sintering, i.e., its silicon and aluminum content avoid aggregation.

DETAILED DESCRIPTION OF THE INVENTION

For a dry reduction treatment, the anti-sintering agent to be added to the material is required to be fine enough to ingress between the particles to be treated, without breaking the latter, e.g., the needles of $\gamma$—FeOOH or $\gamma$—$Fe_2O_3$ during the mixing. The agent is also required to have properties such that it can be subsequently separated with ease by a magnetic separator or the like and will not soften at the reduction temperature exceeding 500° C. Clays, typically kaolin, most adequately meet these requirements.

For a heat treatment, too, the anti-sintering agent to be added should be fine enough to enter between the metal particles without impairing their acicular or linked shape during the mixing. Moreover, the agent should be thoroughly removable from the metal particles in a later stage, e.g., by a magnetic separator. Clay powders, especially kaolin, are extremely suitable for this application because of their desirable properties including fineness, adequate rigidity, and non-magnetism.

For the reasons stated, a clay is an anti-sintering agent useful in both dry reduction and heat treatment. When a magnetic metal powder is to be made by a sequential process of dry reduction followed by a heat treatment, the clay may be used in either stage or both. When the objective powder is to be obtained through wet reduction and subsequent heat treatment, the agent is employed in the latter stage. Particularly, the dry reduction-heat treatment process offers an advantage in that the clay added in the dry reduction stage can be utilized also in the following stage of heat treatment.

Although a small amount of the clay may prove fairly effective, the proportion to be used usually ranges from about one-fifth to about twice the quantity of the powder to be treated, since the clay particles must be abundantly present between the particles of the latter. Too much clay addition is wasteful because it rather lowers the effect and efficacy of treatment.

After the reduction and/or heat treatment, the powdery magnetic metal-clay mixture is taken out of the reactor, stirred in a solvent such as toluene or acetone, placed in a magnetic separator, and the magnetic metal powder is separated for recovery. The metal powder so recovered is transferred, while being protected by the solvent, to a stage for preparing a magnetic coating material.

In accordance with the invention, the reduction treatment can be carried out at a relatively high temperature of 500°–550° C. without the sintering of particles, and therefore a magnetic powder of high quality is manufactured in a stable way with great efficiency. An additional advantage is minimization of the possibility of breaking the acicular or other shape of the magnetic metal particles.

Further, the present invention enables the heat treatment to be conducted at a relatively enhanced temperature around 400° C. without the danger of sintering. This improves the effects of the heat treatment on adjustments of the magnetic properties of the product and shortens the heat treatment time, thus increasing the process efficiency. The shorter mixing time than heretofore is also advantageous because it reduces the possibility of the magnetic metal particles being broken out of shape.

In order to illustrate the advantageous effects of the present invention, Examples and Comparative Examples will be given below, starting with those pertaining to dry reduction:

EXAMPLE 1

Thirty grams of acicular $\alpha$-FeOOH was mixed with the same quantity of kaolin clay powder, and the mixture was subjected to a reduction treatment in a hydrogen stream within a laboratory rotary kiln at 550° C. for one hour. Then, the metal-clay powder mixture was taken out and stirred in a solvent, and the reduced metal powder was recovered by a magnetic separator. The metal particles thus obtained were acicular in shape and showed no trace of sintering.

COMPARATIVE EXAMPLE 1—1

The same procedure as used in Example 1 was followed except that the clay was not added, and a metal powder was recovered. The particles thus obtained had sintered to a marked extent.

EXAMPLE 2

Thirty grams of acicular $\gamma$—$Fe_2O_3$ was mixed with one-fifth by weight of kaolin clay powder and reduced at 500° C. for two hours by the same apparatus as used in Example 1. Following the conclusion of the reduction, the metal powder was recovered in the same manner as in Example 1. No sintering of the particles had taken place.

COMPARATIVE EXAMPLE 2—1

The procedure of Example 2 was repeated with the exception that the clay was not added, and the metal powder was recovered. The particles had been sintered appreciably, though less markedly than in Comparative Example 1—1.

The magnetic metal powders prepared in the four examples described above were tested by means of an oscillation magnetometer, with the application of a magnetic field of 5 KOe, to evaluate their magnetic properties. The results are shown in the following table.

TABLE

| | Coercive force (Oe) | Remanent magnetzn. (emu/g) | Squareness ratio |
|---|---|---|---|
| Example 1 | 1120 | 80.5 | 0.538 |
| Comp. Ex. 1-1 | 430 | 29.1 | 0.187 |
| Example 2 | 1140 | 77.9 | 0.525 |
| Comp. Ex. 2-1 | 580 | 45.6 | 0.302 |

As can be seen from the table, the metal powders reduced in accordance with the process of the invention exhibit quite excellent magnetic properties and very desirable squareness ratios despite the shortness of the treating time, and they are suited for use in manufacturing a high density magnetic recording medium. On the other hand, as represented by the examples for comparison, the metal powders reduced without the addition of clay show very poor results in both magnetic properties and squareness ratio. If the starting metal powder is to attain the properties comparable to those according to the invention by a reduction treatment at a temperature below 500° C., it will need a long treating time of more than 10 hours, and yet some sintering will be inevitable. It will be clearly appreciated from this that the present invention, by contrast, permits the production of a high-quality magnetic metal powder within a very short period of time.

In connection with the heat treatment, further Examples and Comparative Examples will be given below.

EXAMPLE 3

Twenty grams of a magnetic metal powder of a Co-Fe alloy prepared by wet reduction was thoroughly dried, mixed with the same amount of kaolin clay powder, and heat treated in an apparatus provided for that purpose. The apparatus was of the type equipped with a heating jacket around its outer walls and with rotary blades inside. The heat treatment was effected with a hydrogen stream at 400° C. for one hour. After the heat treatment, the mixture of the magnetic metal and the clay powder was discharged from the apparatus and agitated in a solvent, and then the magnetic metal powder was separated and recovered by a magnetic separator. No sintering of the particles was observed.

COMPARATIVE EXAMPLE 3—1

In the same manner as described in Example 1 but without the addition of the clay, the heat treatment was conducted at 400° C. for one hour. The metal particles sintered on the treatment, with a sharp drop in the squareness ratio value.

COMPARATIVE EXAMPLE 3—2

In order to avoid sintering, the heat treatment was done at a lowered temperature of 240° C. for an extended time of 10 hours in a hydrogen stream, again without the addition of the clay.

EXAMPLE 4

Two hundred grams of the same magnetic metal powder as used in Example 1 was thoroughly dried, mixed with a half amount of the clay, and heat treated by the apparatus of Example 1 at 400° C. for three hours. Hydrogen gas was again passed through the charge during the heat treatment. After the treatment the magnetic metal powder was recovered in the same way as in Example 1. There was no evidence of sintering, either.

In order to evaluate the magnetic properties of the magnetic metal powders obtained in the foregoing examples, tests were conducted in a magnetic field of 5 KOe applied by means of an oscillation magnetometer. The results are summarized in the table below.

TABLE

| | Coercive force (Oe) | Remanent magnetzn. (emu/g) | Squareness ratio |
|---|---|---|---|
| Example 3 | 1080 | 72.1 | 0.51 |
| Example 4 | 1070 | 70.3 | 0.51 |
| Comp. Ex. 3-1 | 100 | 19.1 | 0.13 |
| 3-2 | 1100 | 69.5 | 0.51 |

As the table clearly indicates, the magnetic metal powders heat treated in conformity with the present invention display favorable magnetic properties, whereas the magnetic properties of the powder according to Comparative Example 3-1 that sintered are very poor. The powder of Comparative Example 3-2 have magnetic properties well comparable to those of Examples, but poses a problem in manufacturing process in that it took a heat treating time of as long as 10 hours. After all, the heat treatment according to the invention is highly advantageous because it can afford a magnetic metal powder of excellent quality rapidly and stably without the danger of sintering.

What is claimed is:

1. A process for producing a magnetic metal powder which comprises reducing a magnetic metal compound in a state mixed with a clay by dry reduction.

2. A process for producing a magnetic metal powder which comprises heat treating a magnetic metal powder in the presence of a clay powder.

3. A process for producing a magnetic metal powder which comprises preparing a magnetic metal powder by wet reduction and then heat treating the same in the presence of a clay powder.

4. A process for producing a magnetic metal powder which comprises preparing a magnetic metal powder by reducing a magnetic metal compound in a state mixed with a clay by dry reduction and then heat treating said powder in the presence of the clay powder.

5. A process according to any of claims 1 through 4, wherein said clay is kaolin.

* * * * *